United States Patent [19]

Junkers et al.

[11] Patent Number: 5,043,255

[45] Date of Patent: Aug. 27, 1991

[54] COLOR PHOTOGRAPHIC MATERIAL WITH POLYESTER OIL FORMER

[75] Inventors: Günter Junkers, Leverkusen; Klaus Wagner, Bergisch Gladbach; Gerald Karich, Munich; Friedhelm Sommer, Leverkusen, all of Fed. Rep. of Germany

[73] Assignee: Agfa Aktiengesellschaft AG, Leverkusen, Fed. Rep. of Germany

[21] Appl. No.: 415,098

[22] Filed: Sep. 29, 1989

[30] Foreign Application Priority Data

Oct. 15, 1988 [DE] Fed. Rep. of Germany ..... 3835202

[51] Int. Cl.[5] ..... G03C 7/36

[52] U.S. Cl. ..... 430/545; 430/546; 430/551; 430/634

[58] Field of Search ..... 430/546, 545, 551, 634

[56] References Cited

U.S. PATENT DOCUMENTS

| | | | |
|---|---|---|---|
| 4,201,589 | 5/1980 | Sakaguchi et al. | 430/546 |
| 4,419,441 | 12/1983 | Nittel et al. | 430/546 |
| 4,916,050 | 4/1990 | Nishijima et al. | 430/546 |

*Primary Examiner*—Richard L. Schilling

*Attorney, Agent, or Firm*—Connolly & Hutz

[57] ABSTRACT

A color photographic recording material comprising a support and at least one photosensitive silver halide emulsion layer, with which a yellow coupler of the pivaloyl or benzoyl acetanilide type dissolved in a polymeric ester of aromatic or aliphatic dicarboxylic acids is associated, is distinguished by greater color purity and better dark-fading stability.

4 Claims, No Drawings

COLOR PHOTOGRAPHIC MATERIAL WITH POLYESTER OIL FORMER

This invention relates to a color photographic recording material comprising at least one photosensitive silver halide emulsion layer, with which a yellow coupler dissolved in a special oil former is associated. The color photographic recording material according to the invention is distinguished by greater color purity and better dark-fading stability.

It is known that color photographic images can be produced by chromogenic development, i.e. by development of an exposed recording material comprising at least one silver halide emulsion layer with suitable dye-producing developer substances (so-called color developers) in the presence of suitable color couplers, the developer oxidation product formed in accordance with the silver image reacting with the color coupler to form a dye image. The color developers used are normally aromatic compounds containing primary amino groups, more especially of the p-phenylenediamine type. The color couplers are generally present in one or more layers of the color photographic material.

Yellow couplers are generally compounds corresponding to the following formula

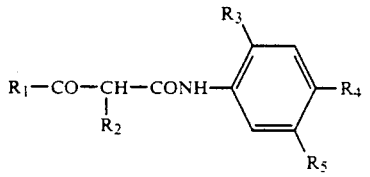

in which $R_1$ represents tert.-butyl or optionally substituted phenyl, $R_2$ represents hydrogen or a releasable group, $R_3$ represents hydrogen, alkoxy or halogen, $R_4$ represents hydrogen, alkoxy or dialkylaminosulfonyl and $R_5$ represents hydrogen, alkoxy or a ballast group, the coupler molecule containing at least one ballast group.

These couplers are dissolved in a solvent, for example tricresyl phosphate and the solution is emulsified in an aqueous gelatine solution. The disadvantage is that the yellow dyes produced from these couplers and the oxidation products of the color developer show an unwanted magenta secondary density and inadequate dark-fading stability (i.e. stability to fading of the dye during storage in darkness).

Accordingly, the object of the present invention is to provide compounds by which these disadvantages can be obviated without having to dispense with the couplers mentioned.

It has now been found that this object can be achieved by using polymeric esters of aromatic or aliphatic dicarboxylic acids, more especially polymeric phthalic acid or adipic acid esters, as oil formers.

Suitable diols are $C_{2-10}$ alkanediols of which the carbon chain may be interrupted by 1 to 3 ether oxygen atoms.

The ratio by weight of coupler to oil former is preferably 1:0.1-2.

The degree of polymerization is adjusted in such a way that the esters are of low viscosity, their viscosity preferably being in the range from 50 to 5,000 mPa.s.

Suitable compounds are:

I-1 polytriethylene glycol nonyl phthalate

I-2 polyhexanediol isodecyl phthalate

I-3 polypropylene glycol adipate

I-4 polybutane(1,3- and 1,4-)diol-2-ethyl propanediol adipate

I-5 poly-1,3-butylene glycol hexane-1,6-diol adipate

I-6 polybutanediol adipate

I-7 polypentanediol adipate

These compounds are prepared in known manner by esterification of the acid anhydrides or acids with the diols.

Lit.:

I. Mellan, Industrial Plasticizers, Pergamon Press 1963

Gnamm, Sommer "Die Lösungs- und Weichmachungsmittel", Stuttgart 1958, pages 708 et seq.

The releasable group $R_2$ of the yellow coupler is, for example, a halogen atom, for example $C_1$, or an organic group which is generally attached to the coupling position of the coupling molecule by an oxygen, sulfur or nitrogen atom. If the releasable group is a cyclic group, it may be attached to the coupling position of the coupler molecule either directly through an atom which is part of a ring, for example a nitrogen atom, or indirectly through an intermediate link. Releasable groups such as these are known in large numbers, for example as leaving groups of 2-equivalent magenta couplers.

Examples of releasable groups attached through oxygen correspond to the following formula $$-O-R^4$$

in which $R^4$ is an acyclic or cyclic organic radical, for example alkyl, aryl, a heterocyclic group or acyl, which is derived for example from an organic carboxylic or sulfonic acid. In particularly preferred releasable groups of this type, $R^4$ is an optionally substituted phenyl group.

Examples of releasable groups attached through nitrogen can be found in the following German Offenlegungsschrifts (DE-A-): 25 36 191, 27 03 589, 28 13 522, 33 39 201.

The groups in question are often 5-membered heterocyclic rings which are attached to the coupling position of the yellow coupler by a ring nitrogen atom. The heterocyclic rings often contain activating groups, for example carbonyl or sulfonyl groups or double bonds, adjacent the nitrogen atom by which they are attached to the coupler molecule.

Where the releasable group is attached to the coupling position of the coupler through a sulfur atom, it may be the residue of a diffusible mercapto compound which is capable of inhibiting the development of silver halide. Inhibitor groups of this type have often been described as a releasable group attached to the coupling position of couplers, including yellow couplers, for example in U.S. Pat. No. 3,227,554.

The yellow coupler used in accordance with the invention may also be a polymeric magenta coupler obtained, for example, by homopolymerization or copolymerization of monomeric couplers which contain an ethylenically unsaturated copolymerizable double bond in one of the substituents. Couplers such as these are described, for example, in DE-A-31 48 125, DE-A-33 00 665, DE-A-33 05 718 and Research Disclosure 25 724 (September 1985).

The following are examples of suitable yellow couplers:
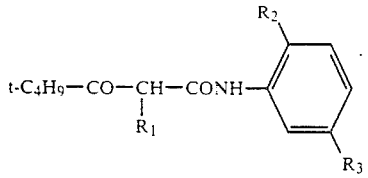
GB 1: $R_1$ = 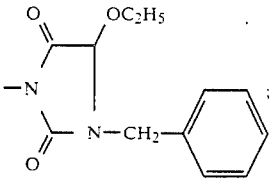 ; $R_2$ = Cl;
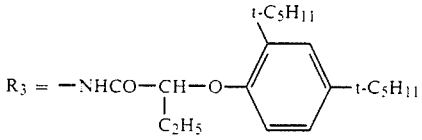
GB 2: $R_1$ = 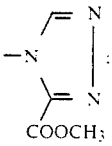 ; $R_2$ = $-OC_{16}H_{33}$; $R_3$ = $-SO_2NHCH_3$
GB 3: $R_1$ =
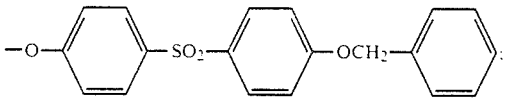
$R_2$ = Cl
$R_3$ = $-NHSO_2-C_{16}H_{33}$
GB 4: $R_1$ = 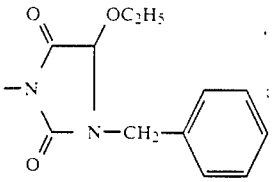 ;
$R_2$ = Cl; $R_3$ = $-COOC_{12}H_{25}$
GB 5: $R_1$ =
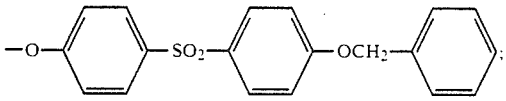
$R_2$ = Cl
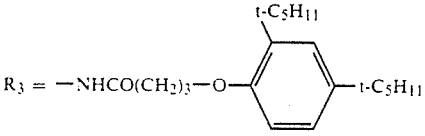
GB 6: $R_1$ = 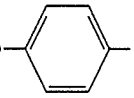 COOH; $R_2$ = Cl;
-continued
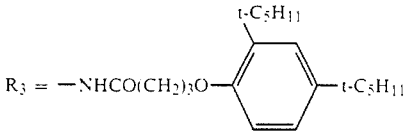
GB 7: $R_1$ = 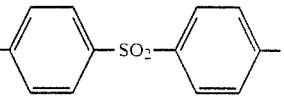 OH; $R_2$ = Cl;
$R_3$ = $-NHSO_2C_{16}H_{33}$
GB 8: $R_1$ = 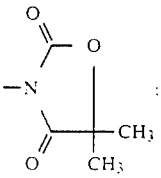 ; $R_2$ = Cl;
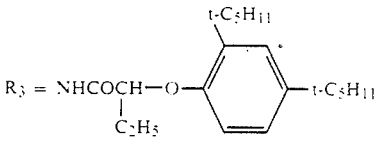
GB 9: $R_1$ = 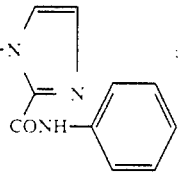 ; $R_2$ = $OC_{16}H_{33}$;
$R_3$ = $-SO_2NHCOC_2H_5$
GB 10: $R_1$ = 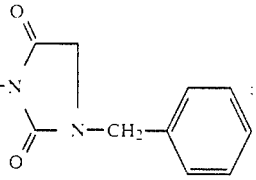 ; $R_2$ = Cl;
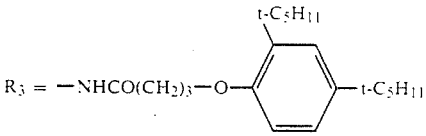
GB 11: $R_1$ = 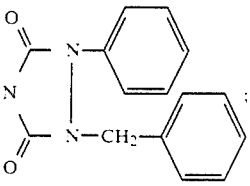 ; $R_2$ = Cl;
GB 12: $R_1$ = 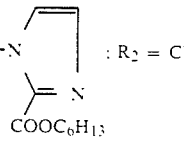 ; $R_2$ = Cl;

-continued

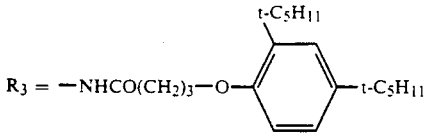

GB 13: $R_1$ = 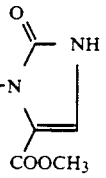 ; $R_2 = -OC_{16}H_{33}$;

$R_3 = -SO_2NHCH_3$

GB 14: $R_1$ = 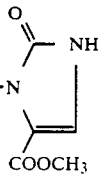 ; $R_2$ = Cl

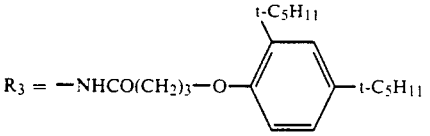

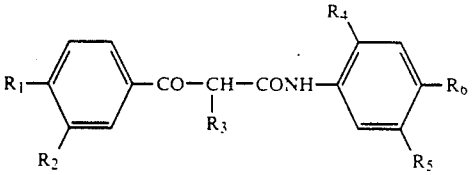

GB 15: $R_1$, $R_3$, $R_5$, $R_6$ = H; $R_4 = -OCH_3$;

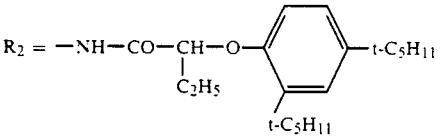

GB 16: $R_2$, $R_6$ = H; $R_1 = -OC_{16}H_{33}$; $R_4$, $R_5 = -OCH_3$;

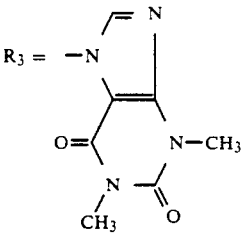

GB 17: $R_2$, $R_6$ = H; $R_1 = -OCH_3$, $R_4$ = Cl;

$R_5 = -COOC_{12}H_{25}$;

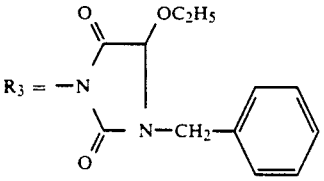

GB 18: $R_2$ = H; $R_1 = -OC_{16}H_{33}$; $R_4$ = Cl;

$R_5$, $R_6 = -OCH_3$;

-continued

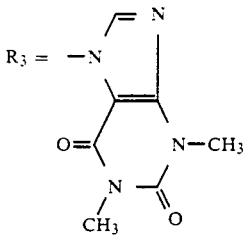

GB 19: $R_2$, $R_5$ = H; $R_1 = -OC_{16}H_{33}$; $R_4 = -OCH_3$;

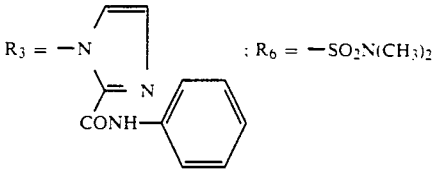

GB 20: $R_2$, $R_6$ = H; $R_1$, $R_4 = -OCH_3$;

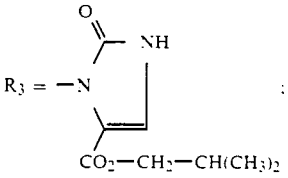

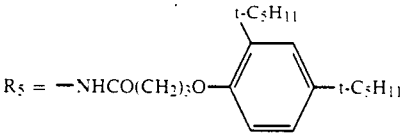

GB 21:

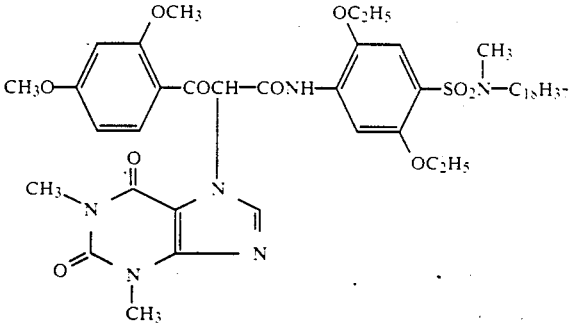

The color photographic recording material according to the invention contains at least one photosensitive silver halide emulsion layer and preferably a succession of several such photosensitive silver halide emulsion layers and, optionally, non-photosensitive binder layers arranged in between; according to the invention, a yellow coupler corresponding to the above formula emulsified with an oil former according to the invention is associated with at least one of the photosensitive silver halide emulsion layers present.

The oil former according to the invention may be used on its own or together with other known oil formers. Where the yellow coupler is dissolved in a mixture of oil formers, at least 50% by weight of the mixture preferably consists of an oil former according to the present invention.

The oil formers are generally high-boiling substances in which the couplers to be dispersed are readily soluble and which are therefore also referred to as coupler solvents.

The photosensitive silver halide emulsions used may contain as halide chloride, bromide and iodide or mixtures thereof. In one preferred embodiment, 0 to 12 mol-% of the halide component of at least one layer consists of iodide, 0 to 50 mol-% of chloride and 50 to 100 mol-% of bromide. In certain embodiments, the silver halide consists of predominantly compact crystals which may have, for example, a cubic or octahedral form or transitional forms. The may be characterized by the fact that they essentially have a thickness of more than 0.2 μm. The average diameter-to-thickness ratio is preferably less than 8:1, the diameter of a crystal being defined as the diameter of a circle with an area corresponding to the projected area of the crystal. In other embodiments, however, all the emulsions or individual emulsions may also comprise essentially platy silver halide crystals in which the diameter-to-thickness ratio is greater than 8:1. The emulsions may be heterodisperse or even monodisperse emulsions which preferably have a mean grain size of 0.3 μm to 1.2 μm. The silver halide crystals may have a multilayer structure.

The emulsions may be chemically or spectrally sensitized in the usual way and may also be stabilized with suitable additives. Suitable chemical sensitizers, spectral sensitizing dyes and stabilizers are described, for example, in Research Disclosure 17 643 (December 1978), cf. in particular Chapters III, IV, and VI.

The color photographic recording material according to the invention preferably contains at least one silver halide emulsion layer for recording light of each of the three spectral regions red, green and blue. To this end, the photosensitive layers are spectrally sensitized in known manner by suitable sensitizing dyes. Blue-sensitive silver halide emulsion layers need not necessarily contain a spectral sensitizer because, in many cases, the natural sensitivity of the silver halide is sufficient for recording blue light.

Each of the photosensitive layers mentioned may consist of a single layer or, in known manner, for example as in the so-called double layer arrangement, may also comprise two or even more partial silver halide emulsion layers (DE-C-1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-1 958 709, DE-A-25 30 645, DE-A-26 22 922).

Color photographic recording materials for the production of multicolor images normally contain color couplers for producing the different component dye images cyan, magenta and yellow in spatial and spectral association with the silver halide emulsion layers of different spectral sensitivity, the yellow couplers dispersed with the oil former according to the invention being associated with a blue-sensitive silver halide emulsion layer.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent, optionally non-photosensitive binder layer.

By spectral association is meant that the spectral sensitivity of each of the photosensitive silver halide emulsion layers and the color of the component dye image produced from the particular spatially associated color coupler bear a certain relationship to one another, a component dye image relating to another color (generally for example the colors cyan, magenta or yellow in that order) being associated with each of the spectral sensitivities (red, green, blue).

One or even several color couplers may be associated with each of the differently spectrally sensitized silver halide emulsion layers. Where several silver halide emulsion layers of the same spectral sensitivity are present, each of them may contain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, therefore, at least one nondiffusing color coupler for producing the cyan component dye image, generally a coupler of the phenol or α-naphthol type, is associated with red-sensitive silver halide emulsion layers. At least one non-diffusing color coupler for producing the magenta component dye image, normally a color coupler of the indazolone type or the pyrazoloazole type, is associated with green-sensitive silver halide emulsion layers. Finally, at least one non-diffusing color coupler for producing the yellow component dye image is associated with blue-sensitive silver halide emulsion layers. Color couplers of this type are known in large numbers and are described in a number of patent specifications. Reference is made here, for example, to the publications entitled "Farbkuppler (Color Couplers)" by W. PELZ in "Mitteilungen aus den Forschungslaboratorien der Agfa, Leverkusen/-Munchen", Vol. III, page 111 (1961) and by K VENKATARAMAN in "The Chemistry of Synthetic Dyes", Vol. 4, 341 to 387, Academic Press (1971).

The color couplers according to the invention, like the other color couplers present in the recording material, may be both typical 4-equivalent couplers and also 2-equivalent couplers in which a smaller quantity of silver halide is required for dye production. 2-Equivalent couplers are known to be derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced. Couplers of the latter type may also be additionally present in the photosensitive silver halide emulsion layers where they serve as mask couplers to compensate the unwanted secondary densities of the image dyes. However, 2-equivalent couplers also include the known white couplers, although couplers such as these do not produce a dye on reaction with color developer oxidation products. 2-Equivalent couplers also include couplers of the type which, in the coupling position, contain a releasable group which is released on reaction with color developer oxidation products and, at the same time, develops a certain desirable photographic activity, for example as a development inhibitor or accelerator. Examples of 2-equivalent couplers of this type are the known DIR couplers and also DAR and FAR couplers. The releasable group may also be a ballast group so that coupling products, for example dyes, which are diffusible or at least show slight or limited mobility are formed during the reaction with color developer oxidation products.

By slight or limited mobility is meant a mobility which is gauged in such a way that the contours of the discrete dye patches formed during chromogenic development blend and merge with one another. This degree of mobility should be distinguished, on the one hand, from the usual case of complete immobility in photographic layers which, in conventional photographic recording materials, is required for the color couplers or rather for the dyes produced therefrom in order to obtain maximal definition and, on the other hand, from the case of total mobility of the dyes as required, for example, in dye diffusion processes. The extent of the slight mobility required in accordance with the invention may be controlled by I0 variation of substituents in order, for example, specifically to influence solubility in the organic medium of the oil former or affinity for the binder matrix.

Suitable layer supports for the recording materials according to the invention are the usual types, for example supports of cellulose esters, for example cellulose acetate, and of polyesters. Other suitable supports are paper supports which may optionally be coated, for example with polyolefins, particularly polyethylene or polypropylene, cf. Research Disclosure 17643, Chapter XVII.

Suitable protective colloids or binders for the layers of the recording material are any of the usual hydrophilic film-forming agents, for example proteins, particularly gelatine. Casting aids and plasticizers may be used, cf. Research Disclosure 17643, Chapters IX, XI and XII.

The layers of the photographic material may be hardened in the usual way, for example with hardeners containing at least two reactive oxirane, aziridine or acryloyl groups. The layers may also be hardened by the method described in DE-A-22 18 009. It is also possible to harden the photographic layers or rather the color -photographic multilayer materials with hardeners of the diazine, triazine or 1,2-dihydroquinoline series or with hardeners of the vinyl sulfone type. Other suitable hardeners are known from DE-A-22 25 230, DE-A-23 17 677, DE-A-24 39 551 and from Research Disclosure 17643, Chapter X. The stabilizing effect of the oil formers according to the invention is particularly pronounced where hardeners which activate carboxyl groups, for example carbamoyl pyridinium or carbamoyloxy pyridinium salts are used.

Other suitable additives are described in Research Disclosure 17643 and in "Product Licensing Index" of December 1971, pages 107–110.

Suitable color developer compounds for the material according to the invention are, in particular, those of the p-phenylenediamine type, for example 4-amino-N,N-diethyl aniline hydrochloride, 4-amino-3-methyl-N-ethyl-N-β-(methanesulfonamido)-ethyl aniline sulfate hydrate, 4-amino-3-methyl-N-ethyl-N-β-hydroxyethyl aniline sulfate, 4-amino-N-ethyl-N-(2-methoxyethyl)-m-toluidine di-p-toluenesulfonic acid and N-ethyl-N-B-hydroxyethyl p-phenylenediamine. Other useful color developers are described, for example, in J. Amer. Chem. Soc. 73, 3100 (1951) and in G. Haist, Modern Photographic Processing, 1979, John Wiley and Sons, New York, pages 545 et seq.

After color development, the material is bleached and fixed in the usual way. Bleaching and fixing may be carried out separately or even together with one another. Suitable bleaches are any of the usual compounds, for example $Fe^{3+}$ salts and $Fe^{+}$ complex salts, such as ferricyanides, dichromates, water-soluble cobalt complexes, etc. Particular preference is attributed to iron(III) complexes of aminopolycarboxylic acids, more especially for example ethylenediamine tetraacetic acid, nitrilotriacetic acid, iminodiacetic acid, N-hydroxyethyl ethylenediamine triacetic acid, alkyliminodicarboxylic acids, and of corresponding phosphonic acids. Persulfates are also suitable bleaches.

In the case of color reversal materials, which are preferred in the context of the invention, color development is preceded by black-and-white development and by a diffuse second exposure or by chemical fogging.

EXAMPLE 1

(single layer)

A color photographic recording material was prepared by applying the following layers int the order indicated to a transparent layer support of cellulose triacetate. The quantities shown are all based on 1 square meter. For the silver halide applied, the corresponding quantities of $AgNO_3$ are shown. All the silver halide emulsions were stabilized with 0.5 g 4-hydroxy-6-methyl-1,3,3a,7-tetraazaindene per 100 g $AgNO_3$.

| | |
|---|---|
| Layer 1 | (antihalo layer)<br>black colloidal silver sol containing 1.5 g gelatine and 0.33 g Ag. |
| Layer 2 | (intermediate layer)<br>0.6 g gelatine |
| Layer 3 | (blue-sensitive layer)<br>blue-sensitized silver bromide iodide emulsion (4 mol-% iodide: mean grain diameter 0.3 μm) of 2.0 g $AgNO_3$ containing 2.3 g yellow coupler GB 19 emulsified in 1.15 g oil former and 2.8 g gelatine. |
| Layer 4 | (protective layer)<br>1.2 g gelatine |
| Layer 5 | (hardening layer)<br>1.3 g gelatine and 0.5 g of a hardener corresponding to the following formula |

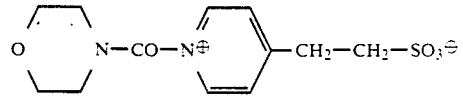

Three different versions of the recording material were prepared (samples 1, 2 and 3), differing only in the type of oil former used in layer 3. In sample 1, 100% of the oil former consisted of tricresyl phosphate (TCP). In sample 2, 50% by weight of the oil former consisted of TCP and 50% by weight of I-2. In sample 3, 100% of the oil former consisted of I-2.

The samples thus prepared were exposed and developed by standard color reversal development, cf. Example 2 of EP-A 62 202.

The absorption curves of the developed samples were each measured for density 1.0 and the slope separation at 50% absorption and the wavelength reached on the long-wave slope at 30% absorption were determined therefrom. The results are shown in Table 1.

Samples 2 and 3 show a distinctly narrower slope separation interval of the absorption curve and do not reach as far into the long-wave, green absorption range as sample 1. Accordingly, they show a purer, less magenta yellow than sample 1.

To test dye stability during storage in darkness, the developed samples are stored for 14, 28 and 42 days at 80° C./40% relative humidity and the change in the maximum density is measured. The relative maximum densities $D_t/D_{10}\cdot 100$ shown in Table 1 reflect a much higher dark-fading stability for samples 2 and 3.

EXAMPLE 2

(double layer)

A color photographic recording material for reversal color development was prepared by applying the following layers in the order indicated to a transparent layer support of cellulose tri-acetate. The quantities shown are all based on 1 square meter. For the silver halide applied, the corresponding quantities of $AgNO_3$ are shown. All the silver halide emulsions were stabilized with 0.5 g 4-hydroxy-6-methyl-1,3,3a,7-tetraazaindene per 100 g $AgNO_3$.

| | |
|---|---|
| Layer 1 | (anti-halo layer)<br>black colloidal silver sol containing 1.5 g gelatine and 0.33 g Ag. |
| Layer 2 | (intermediate layer)<br>0.6 g gelatine |
| Layer 3 | (1st blue-sensitive layer)<br>blue-sensitized silver bromide iodide emulsion (4 mol-% iodide; mean grain diameter 0.25 μm) of 0.5 g $AgNO_3$ containing 0.6 g yellow coupler GB 19 emulsified with 0.3 g TCP and 0.75 g gelatine. |
| Layer 4 | (2nd blue-sensitive layer)<br>blue-sensitized silver bromide iodide emulsion (3 mol-% iodide; mean grain diameter 0.8 μm) of 1.15 g $AgNO_3$ containing 1.35 g yellow coupler GB 19 emulsified with 0.7 g TCP and 1.6 g gelatine. |
| Layer 5 | (3rd blue-sensitive layer)<br>blue-sensitized silver bromide iodide emulsion (4 mol-% iodide; mean grain diameter 0.03 μm) of 0.2 g $AgNO_3$ containing 0.8 g of a standard UV absorber and 0.8 g gelatine. |
| Layer 6 | (protective layer)<br>0.7 gelatine. |
| Layer 7 | (hardening layer)<br>1.5 g gelatine and 0.7 g of the hardener described in Example 1. |

Three different versions of this recording material were prepared (samples 4, 5 and 6), differing only in the type of oil former used in layers 3 and 4.

In sample 4, 100% by weight of the oil former consisted of TCP. In sample 5, 50% by weight of the oil former consisted of TCP and 50% by weight of I-2. In sample 6, I00% by weight of the oil former consisted of I-2.

Processing and evaluation were the same as in Example 1. The results (color purity and dark-fading stability) are shown in Table 1. Versions 5 and 6 according to the invention again show higher color purity and better dark-fading stability.

TABLE 1

| Sample no. | | Slope separation of absorption curve in nm at half density | Absorption wavelength at 30% density of long-wave slope | Dark-fading stability: initial density | residual density [%] 14d | 28d | 42d |
|---|---|---|---|---|---|---|---|
| 1 | Comparison | 89 | 507 | 3.10 | 95 | 83 | 69 |
| 2 | Invention | 84 | 499 | 3.05 | 96 | 87 | 77 |
| 3 | Invention | 80 | 492 | 3.08 | 98 | 92 | 82 |
| 4 | Comparison | 92 | 510 | 3.14 | 96 | 85 | 71 |
| 5 | Invention | 86 | 501 | 3.18 | 97 | 90 | 79 |
| 6 | Invention | 81 | 494 | 3.12 | 100 | 96 | 86 |

EXAMPLE 3

A color photographic recording material for reversal color development was prepared by casting the following layers in the order indicated onto a transparent layer support of cellulose triacetate. The quantities shown are all based on 1 square meter. For the silver halide applied, the corresponding quantities of $AgNO_3$ are shown. All the silver halide emulsions were stabilized with 0.5 g 4-hydroxy-6-methyl-1,3,3a,7-tetraazaindene per 100 g $AgNO_3$.

| | |
|---|---|
| Layer 1 | (antihalo layer)<br>black colloidal silver sol containing 1.5 g gelatine and 0.33 g Ag. |
| Layer 2 | (intermediate layer)<br>0.6 g gelatine. |
| Layer 3 | (1st red-sensitized layer)<br>red-sensitized silver bromide iodide emulsion (4 mol-% iodide; mean grain diameter 0.25 μm) of 1.3 g $AgNO_3$ containing 0.38 g cyan coupler C-1 emulsified in 0.19 g TCP and 1.3 g gelatine. |
| Layer 4 | (2nd red-sensitized layer)<br>red-sensitized silver bromide iodide emulsion (3 mol-% iodide; mean grain diameter 0.8 μm) of 2.0 g $AgNO_3$ containing 1.2 g cyan coupler C-1 emulsified in 0.6 g TCP and 1.8 g gelatine. |
| Layer 5 | (intermediate layer)<br>1.1 g gelatine and 0.5 g 2,5-diisooctyl hydroquinone. |
| Layer 6 | (1st green-sensitized layer)<br>green-sensitized silver bromide iodide emulsion (4 mol-% iodide; mean grain diameter 0.25 μm) of 1.3 g $AgNO_3$ containing 0.32 g magenta coupler M-1 emulsified with 0.16 g TCP and 1.0 g gelatine. |
| Layer 7 | (2nd green-sensitized layer)<br>green-sensitized silver bromide iodide emulsion (3 mol-% iodide, mean grain diameter 0.8 μm) of 1.4 g $AgNO_3$ containing 1.16 g magenta coupler M-1 emulsified in 0.58 g TCP and 1.35 g gelatine. |
| Layer 8 | (yellow filter layer)<br>yellow colloidal silver sol containing 0.18 g Ag, 1.0 g gelatine and 0.3 g 2,5-diisooctyl hydro- |

-continued

| | |
|---|---|
| | quinone. |
| Layer 9 | (1st blue-sensitive layer) |
| | blue-sensitized silver bromide iodide emulsion (4 mol-% iodide; mean grain diameter 0.25 μm) of 0.5 g $AgNO_3$ containing 0 6 g yellow coupler GB 19 emulsified with 0.3 g oil former I-2 and 0.75 g gelatine. |
| Layer 10 | (2nd blue-sensitive layer) |
| | blue-sensitized silver bromide iodide emulsion (3 mol-% iodide; mean grain diameter 0.8 μm) of 1.15 g $AgNO_3$ containing 1.35 g yellow coupler GB 19 emulsified with 0.3 g oil former I-2 and 1.6 g gelatine. |
| Layer 11 | (3rd blue-sensitive layer) |
| | blue-sensitized silver bromide iodide emulsion (4 mol-% iodide; mean grain diameter 0.03 μm) of 0.2 g $AgNO_3$ containing 0.8 g of a standard UV absorber and 0.8 gelatine. |
| Layer 12 | (protective layer) |
| | 0.7 g gelatine. |
| Layer 13 | (hardening layer) |
| | 1.5 g gelatine and 0.7 g of the hardener described in Example 1. |

The treatment and processing were the same as in Example 1. The image obtained showed pure colors, particularly a pure yellow, and very good dark-fading stability.

The following couplers were used:

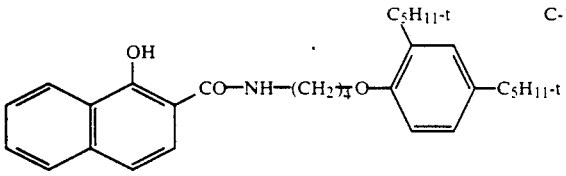

-continued

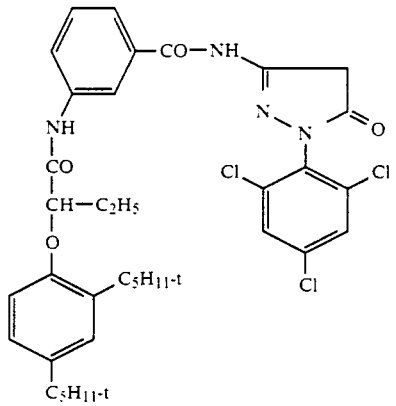

We claim:

1. A color reversal photographic for exposure and development by reversal color development comprising a support and at least one photosensitive silver halide emulsion layer with which a yellow coupler dissolved in an oil former is associated, characterized in that the yellow coupler corresponds to the following formula

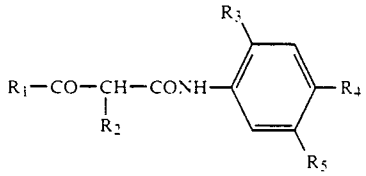

in which $R_1$ represents tert.-butyl or optionally substituted phenyl, $R_2$ represents hydrogen or a releasable group.

$R_3$ represents hydrogen, alkoxy or halogen, $R_4$ represents hydrogen, alkoxy or dialkylaminosulfonyl and $R_5$ represents hydrogen, alkoxy or a ballast group, the coupler molecule containing at least one ballast group, and in that the oil former consists essentially of a polymeric ester of aromatic dicarboxylic acid.

2. A color reversal photographic recording material as claimed in claim 1, characterized in that the oil former has a viscosity of 50 to 5,000 mPa.s.

3. A color reversal photographic recording material as claimed in claim 1, characterized in that the ratio by weight of coupler to oil former is 1:0.1–2.

4. A color photographic recording material as claimed in claim 1, characterized in that a polymeric phthalic acid ester is used as the oil former.

* * * * *